US006905268B1

(12) United States Patent
Holland et al.

(10) Patent No.: US 6,905,268 B1
(45) Date of Patent: Jun. 14, 2005

(54) CLUTCH MECHANISM WITH ONE PIECE PLASTIC SPOOL

(75) Inventors: Carl William Holland, Webster, NY (US); Paul J. Szwejbka, Fairport, NY (US)

(73) Assignee: Nu-Kote International, Inc., Dallas, TX (US)

( * ) Notice: Subject to any disclaimer, the term of this patent is extended or adjusted under 35 U.S.C. 154(b) by 0 days.

(21) Appl. No.: 10/427,290

(22) Filed: May 1, 2003

Related U.S. Application Data

(63) Continuation-in-part of application No. 09/995,353, filed on Nov. 27, 2001, now abandoned.

(51) Int. Cl.[7] ..... B65H 75/00

(52) U.S. Cl. ..... 400/242; 400/208.1; 400/236; 400/236.1

(58) Field of Search ..... 400/242, 248, 400/236, 246, 208, 208.1, 236.1

(56) References Cited

U.S. PATENT DOCUMENTS

| | | | | |
|---|---|---|---|---|
| 3,782,651 | A | 1/1974 | Hengelhaupt et al. | |
| 4,327,874 | A | 5/1982 | Bruno | |
| 4,615,628 | A | 10/1986 | Swinburne | |
| 4,729,526 | A * | 3/1988 | Becker et al. | 242/118.1 |
| 5,060,882 | A | 10/1991 | Rousculp et al. | |
| 5,100,250 | A | 3/1992 | Suzuki et al. | |
| D355,436 | S | 2/1995 | Suwa | |
| 5,433,539 | A | 7/1995 | German | |
| D383,743 | S | 9/1997 | Suwa et al. | |
| 5,695,292 | A * | 12/1997 | Coote | 400/250 |
| 5,775,821 | A | 7/1998 | Kato | |
| 5,897,256 | A | 4/1999 | Kameyama | |
| 5,913,621 | A | 6/1999 | Kameyama et al. | |
| 5,961,229 | A | 10/1999 | Kameyama | |
| 5,984,546 | A | 11/1999 | Kameyama | |
| D425,545 | S | 5/2000 | Ishida | |
| 6,079,886 | A | 6/2000 | Kameyama | |
| 6,109,801 | A * | 8/2000 | Mabit | 400/242 |
| 6,161,972 | A | 12/2000 | Kameyama et al. | |
| 6,195,111 | B1 * | 2/2001 | Nelson et al. | 347/214 |
| D442,211 | S | 5/2001 | Hayashi et al. | |

(Continued)

FOREIGN PATENT DOCUMENTS

| | | |
|---|---|---|
| EP | 0 852 182 A1 | 7/1998 |

(Continued)

*Primary Examiner*—Andrew H. Hirshfeld
*Assistant Examiner*—Dave A. Ghatt
(74) *Attorney, Agent, or Firm*—Fay, Sharpe, Fagan, Minnich & McKee, LLP

(57) ABSTRACT

An ink ribbon cartridge has a take-up spool (130) with an opening having a plurality of drive surfaces (200) and slip surfaces (202). The take up spool is preferably of a one-piece construction. A first spindle with a cantilever member (196) and a tab (198) extending therefrom is mounted on the take-up spool. When the drive surface engages a tab of the spindle, rotation of the spindle rotates the take-up spool. When one of the slip surfaces engages the tab of the spindle, the spindle rotates relative to the take-up spool.

23 Claims, 6 Drawing Sheets

U.S. PATENT DOCUMENTS

| | | | | |
|---|---|---|---|---|
| 6,257,780 | B1 | 7/2001 | Ito et al. | |
| 6,425,548 | B2 * | 7/2002 | Christensen et al. | 242/571.4 |
| 6,609,678 | B2 * | 8/2003 | Seybold et al. | 242/611.2 |
| 6,623,192 | B1 * | 9/2003 | Kameyama | 400/208 |
| 6,726,144 | B2 * | 4/2004 | Squires | 242/597.6 |
| 2001/0046399 | A1 | 11/2001 | Hayashi | |

FOREIGN PATENT DOCUMENTS

| | | | |
|---|---|---|---|
| EP | 0 931 672 | A1 | 7/1999 |
| EP | 0 852 182 | B1 | 11/1999 |
| EP | 1 000 765 | A2 | 5/2000 |
| JP | 2001 26156 | A | 1/2001 |

* cited by examiner

CLUTCH MECHANISM WITH ONE PIECE PLASTIC SPOOL

This application is a continuation-in-part of application Ser. No. 09/995,353 filed Nov. 27, 2001.

BACKGROUND OF THE INVENTION

This invention relates generally to an ink ribbon cartridge for use in a recording device, and more specifically to a take-up spool for ink ribbon cartridges including a tube and clutch mechanism.

In a thermal ink ribbon cartridge, an ink ribbon is wound around a supply spool tube and extends to a take-up spool tube. An ink layer is formed on one surface of the ink ribbon. A spindle without a gear is provided at one end of each of the supply tube and the take-up tube while a spindle with a gear is provided at the other end of the supply tube and take-up tube. The spindles are selectively removable from the supply and take-up tubes.

At the time of ink ribbon replacement, each of the spindles is removed from a snap fit engagement with a corresponding hole in the housing of the ink ribbon cartridge. Then, the spindles are removed from their corresponding ends of the supply and take-up tubes. Replacement tubes with ink ribbon are installed onto the take-up and supply spindles and are reattached to the ink ribbon cartridge housing. Subsequently, the ink ribbon cartridge is mounted in a printer or facsimile system. If an ink ribbon is improperly mounted or the direction of winding is reversed from the proper direction, the ink ribbon cannot be wound up thus resulting in a failure in printing.

Existing cartridges use a clutching mechanism for an ink ribbon take-up tube which has three separate components, in addition to the tube, namely a gear, a hub and a tube insert. As shown in FIG. 1A, a take-up tube 10 has an opening 12 extending therethrough and one or two slots 14 in each end of the tube. The tube 10, which is made of cardboard, receives a plastic insert 20 which is inserted into the end of the tube and has tabs (not shown) which engage the slots 14 and snap the insert into place within the tube opening. The insert remains as part of the take-up tube. The insert has a lip 22 which engages an end surface of the cardboard tube. The insert has an opening 24 extending therethrough. Referring to FIG. 1B, at an end 26 of the insert, which is opposite the end with lip 22 are a series of drive surfaces 28 and slip surfaces 30 formed by angled slots 32 formed at equally spaced apart areas along a perimeter of the insert. The drive and slip surfaces extend axially inwardly from end surface 26 of the insert 20. The drive surfaces are substantially radial edges which form an abutment shoulder for drivingly engaging with a drive lug of a drive gear. The slip surfaces are smooth, tapered surfaces or slopes which have a chord component which allows the drive lug to slip along the surfaces.

A hub 40 is snap fit onto a drive gear assembly 50. The hub has several prongs 42 which extend axially from a flat disk surface 44 and extend into matching slots 52 in the drive gear. The prongs are then locked into place within the gear and attach the hub to the gear. The hub further comprises a central portion 46 having an opening 47 therethrough and an end portion 48 with a slot 49 therethrough. The drive gear assembly includes an elongated leg portion 54 which extends through the opening in the central portion of the hub. Portion 54 includes a cantilever member 56 which is formed between grooves in the leg portion. The cantilever member includes a drive lug 58 formed at an end thereof. The cantilever drive lug extends through opening 47 of the hub and protrudes through slot 49. The drive lug is formed of a resilient material and can be depressed radially inwardly toward the hub center as the hub and drive gear are installed together. Once the drive lug is fully received in the hub, it extends radially outwardly through the slot of the hub and is locked within the slot.

The drive gear and hub assembly are then inserted into the plastic insert 20 in the cardboard tube. The drive lug is again depressed radially inwardly as the hub is axially inserted through the opening 24 in the insert 20 until the lug reaches the drive and slip surfaces at the end of the insert. The lug remains depressed inwardly by the slip surfaces 30 and does not allow the cardboard tube to rotate with the drive gear. That is, the drive lug allows the drive gear and hub to rotate counter-clockwise (see FIG. 1B) with respect to the slip surfaces but does not engage or lock to the insert. The drive gear and hub rotate counter-clockwise with respect to the slip surfaces and do not engage the insert thus not rotating the cardboard tube.

However, if the hub and drive gear are rotated in the opposite direction, i.e. clockwise, the drive lug extends through one of the slots of the insert and engages one of the drive surfaces 28 thus rotating the insert and the cardboard tube in a clockwise manner in FIG. 1B. Thus, the cardboard tube and the take-up spool can only rotate in one direction as driven by the drive gear.

A problem with this existing design is that the end of the cardboard tube with the plastic insert can only accommodate the drive gear with the hub and drive lug. This end is not compatible with any of the spindles or other drive gear arrangements. Further, the design requires four parts and is structurally complex and expensive.

Thus, a one piece tube which accomplishes the same function of permitting rotation of the take-up tube in only one direction would be desirable. This tube would also be compatible with other drive gears and supply spindles. Furthermore, no separate insert would be required in the tube and the hub component can be eliminated. Accordingly, it is desirable to provide a new and improved take-up spool for an ink ribbon cartridge which would meet the above stated needs and others and provide better, more advantageous overall results.

SUMMARY OF THE INVENTION

Generally speaking, the present invention relates to a take-up spool for an ink ribbon cartridge which uses a clutch mechanism which prevents improper winding of the take-up spool thus preventing failure in printing.

More particularly, the invention relates to an ink ribbon cartridge spool comprising a one piece plastic tube which is structured to provide a clutch mechanism with a gear spindle. The take-up spool tube is preferably made of plastic and has an opening for receiving hub and cantilevered members of a drive gear spindle. The cantilevered member contacts drive and clutch components in the spool opening and either drives the spool or slips and does not drive the spool while the cantilevered member is rotated. Thus, the drive gear can only rotate the spool in one direction and cannot rotate it in the opposite direction.

This is accomplished by including a plurality of drive surfaces and slip surfaces generally equally spaced apart within the plastic tube. The cantilever member of the drive gear has a tab which engages the drive surfaces and slip surfaces. The cantilevered member is deflected inwardly when the tab is pushed against the slip surfaces in the plastic tube while being rotated in one direction. When rotated in the opposite direction, the cantilevered member end engages one of the drive surfaces and provides a positive drive when rotated against the plastic tube thus rotating the take-up spool with the drive gear.

In particular, the present invention relates to an ink ribbon cartridge, having a housing, an ink ribbon wound about the tube of a supply spool and the tube of a take-up spool for holding the ribbon. Each spool tube has a first and second end with an opening. Each spool is also removably mounted in the housing. The first and second end of the supply spool tube and the first end of the take-up spool tube each have at least one slot formed in the end. A second end of the take-up spool tube has an opening having a plurality of notches or recesses therein each including a drive surface and a slip surface. The take-up spool tube is preferably of a one-piece construction.

A first spindle with a cantilever member and a tab extending therefrom is mounted on the second end of the take-up spool tube. When the drive surface engages the tab on the cantilever member of the spindle, rotation of the spindle rotates the take-up spool tube and thus the take-up spool. When one of the slip surfaces engages the tab, rotation of the spindle does not rotate the take-up spool tube. Rather, the tab slides along the slip surface and is deflected inwardly toward the center of the spool tube. Thus, the take-up spool tube and spindle act as a clutch mechanism.

Second and third spindles are mounted on the first and second ends of the supply spool tube and a fourth spindle is mounted on the first end of the take-up spool tube. The fourth spindle engages a slot in the second end of the take-up spool tube, and the second and third spindles each engage one of the slots in the first and second ends of the supply spool tube. Each spindle has a disk portion and a tab which engages one of the slots of the spool tubes. The first and third spindles each further have a gear section. The fourth spindle can also have a cantilever member with a tab which is received by a slot in the first end of the take-up spool tube.

One advantage of the present invention is the provision of a clutch mechanism which uses a one-piece spool tube which provides drive surfaces and slip surfaces for allowing or preventing rotation of the spool tube with respect to a drive gear.

Another advantage of the present invention is the provision of a spool which does not require a separate insert to be inserted in one end of the spool tube, thus allowing each end of the spool tube to receive take-up or supply spindles.

Yet another advantage of the present invention is the provision of a take-up spool structure which minimizes the number of parts and is easy to manufacture.

Still other aspects and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 2:
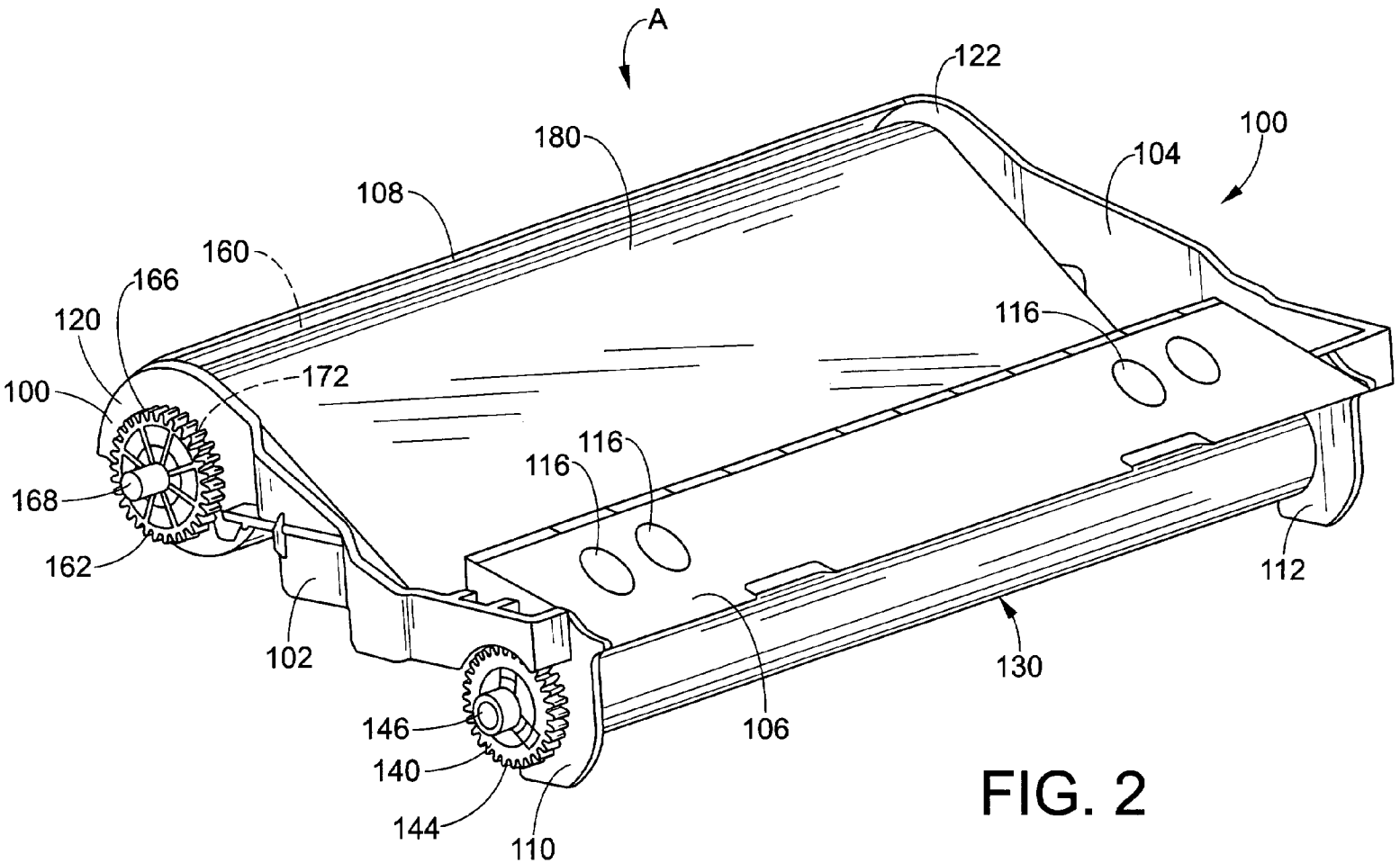
FIG. 2 is a perspective view of an ink ribbon cartridge in accordance with the present invention.
Figure 3:
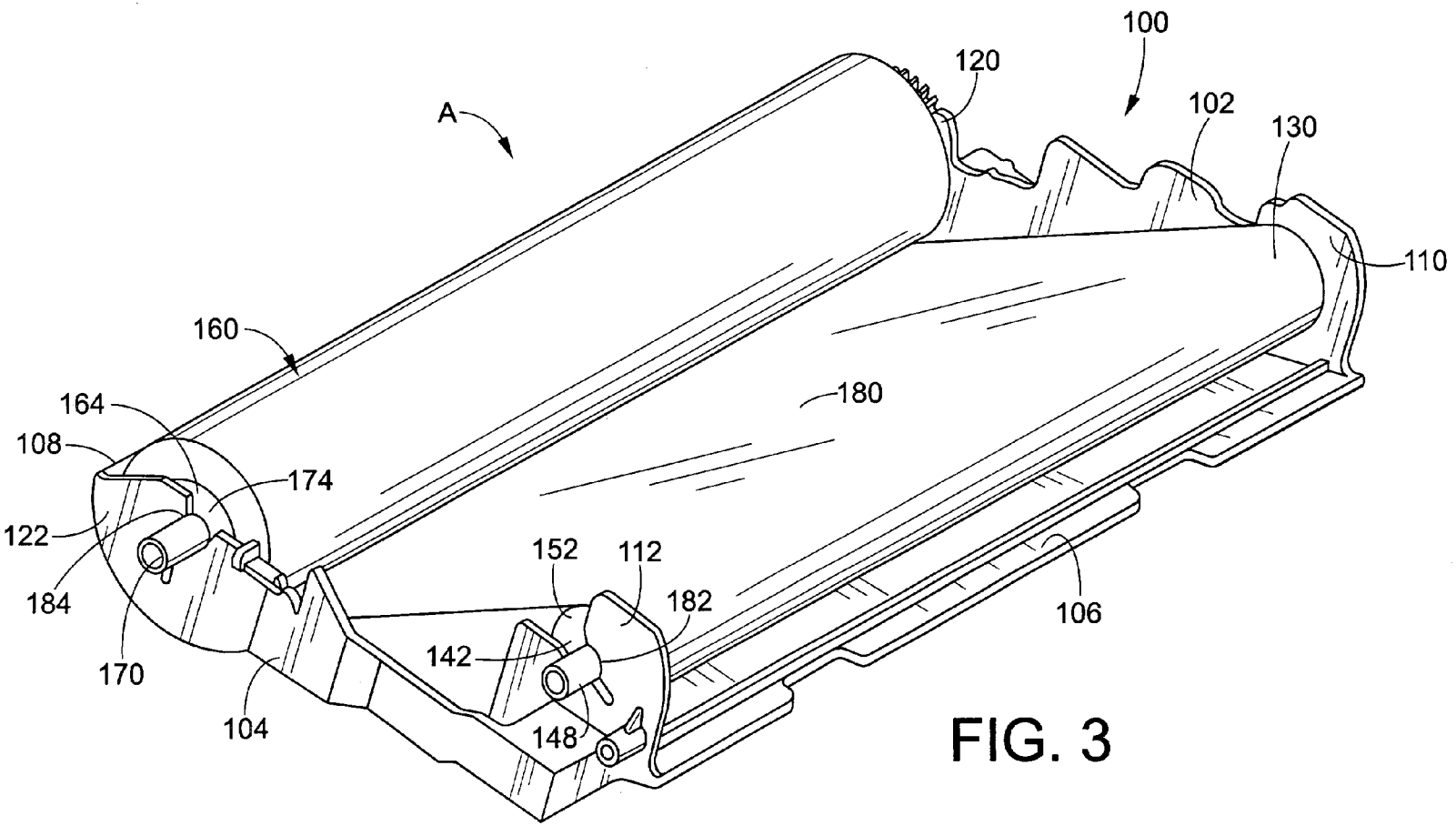
FIG. 3 is a perspective view of the underside of the ink ribbon cartridge of FIG. 2.

Referring now to the drawings, wherein the showings are for purposes of illustrating the preferred embodiment of the invention only and not for purposes of limiting same, FIGS. 2 and 3 show an ink ribbon cartridge in accordance with a preferred embodiment of the present invention.

More particularly, an ink ribbon cartridge A comprises a housing 100, a first wall 102, a second wall 104, a third wall 106, and a fourth wall 108. First and second walls 102, 104 form connection members which extend between and connect the third wall to the fourth wall. The first and second walls are spaced apart and generally parallel to each other. Similarly, the third and fourth walls are spaced apart and are generally parallel to each other. The third wall 106 comprises wall sections 110, 112 which extend from the ends of the wall. Each wall 110, 112 has an opening for receiving a spindle attached to a spool tube which extends between the walls 110, 112. Wall 106 partially covers the spool and is generally parallel thereto. Preferably, wall 106 has a flat surface extending between the walls 110, 112. Wall 106 further comprises a series of spaced apart slots or openings 116 which are used to grasp the ribbon cartridge by a user's fingers and to lift and install the ink ribbon cartridge into a printer.

Wall 108 has a generally semi-cylindrical shape and extends between sides 102, 104. Wall 108 further comprises wall portions 120, 122 which extend downwardly from a top surface of wall 108, as shown in FIG. 2. Sections 120, 122 each comprise an opening for receiving a spindle attached to the spool tube of the spool which extends between the two sections.

A take-up spool 130 extends between walls 110, 112. The take-up spool includes a one-piece spool tube 132 and is preferably made of plastic, although other materials may be used without departing from the scope of the invention. Spindles 140, 142 are attached to opposite ends of the spool tube. Spindle 140 has a gear section 144. Spindle 142 does not have a gear. Each spindle is preferably molded of a resin material; however, other materials may be used without departing from the scope of the invention. Each spindle 140, 142 comprises a cylindrical portion 146, 148, respectively, and a flat disk section 150, 152, respectively, adjacent gear 140 and cylindrical portion 148.

A supply spool 160 extends between walls 120, 122. Spool 160 includes a spool tube which is preferably made of cardboard but may be formed of an alternative material. A spindle 162 is attached to one end of the spool tube and a spindle 164 is attached at the other end of the tube. Spindle 162 has a gear section 166, but spindle 164 does not have such a gear section. Each spindle comprises a cylindrical portion 168, 170, and a flat disk portion 172, 174, respectively. An ink ribbon 180 extends between and is connected onto take-up spool 130 and supply spool 160. The ink ribbon has an ink layer on one side. The ink ribbon is formed with a broad width resin film and has an ink surface onto which the ink layer is formed. Spindles 142, 164 are received in semi-circular notches or cut-outs 182, 184 in the walls 112, 122 of the cartridge. Similarly, the gear spindles 140, 162 are received in semi-circular notches (not shown) in walls 110, 120. Each end of the tube of spool 160 has one or two slots, preferably 180 degrees apart, which receive tabs extending from one of the ends of each spindle.

Figure 4:
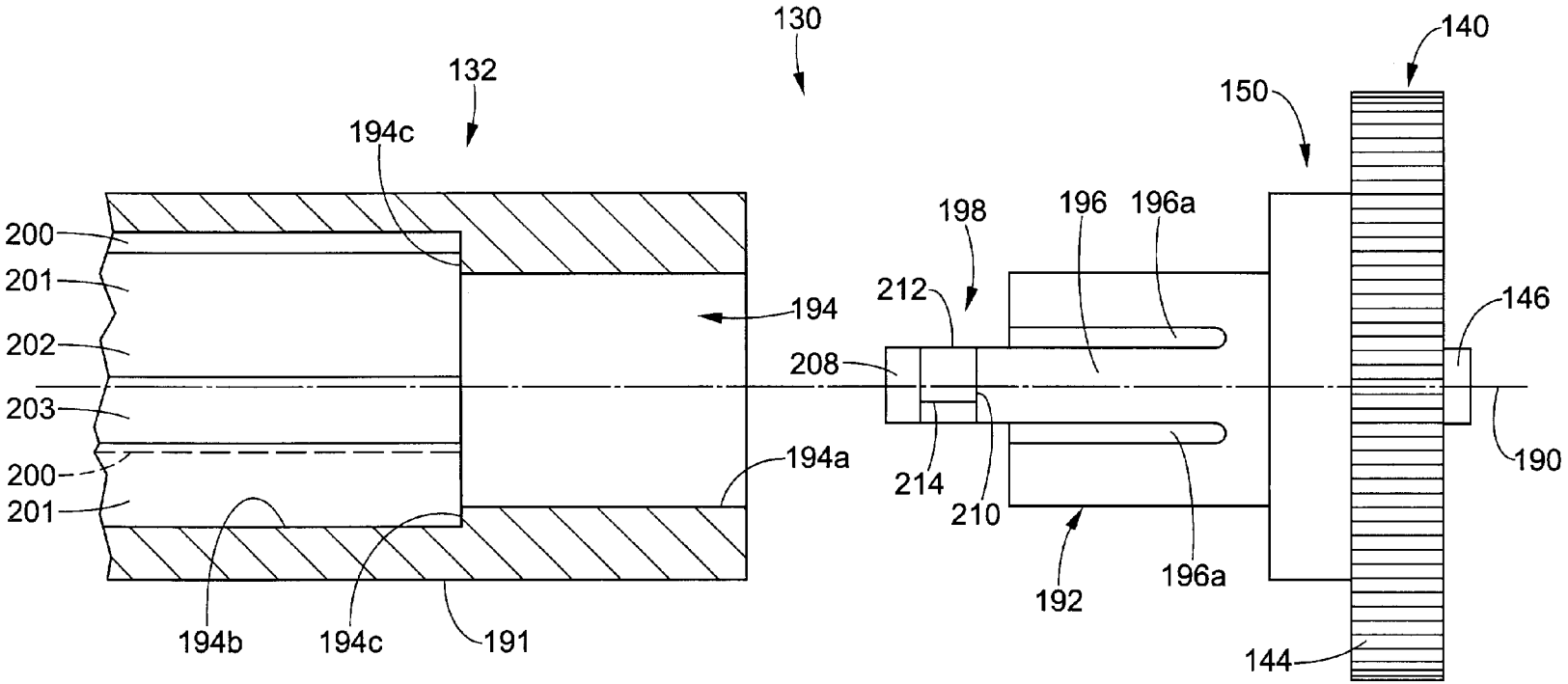
FIG. 4 is an exploded side elevational view, partially in section, illustrating the component parts of a take-up spool in accordance with a preferred embodiment.
Figure 5:
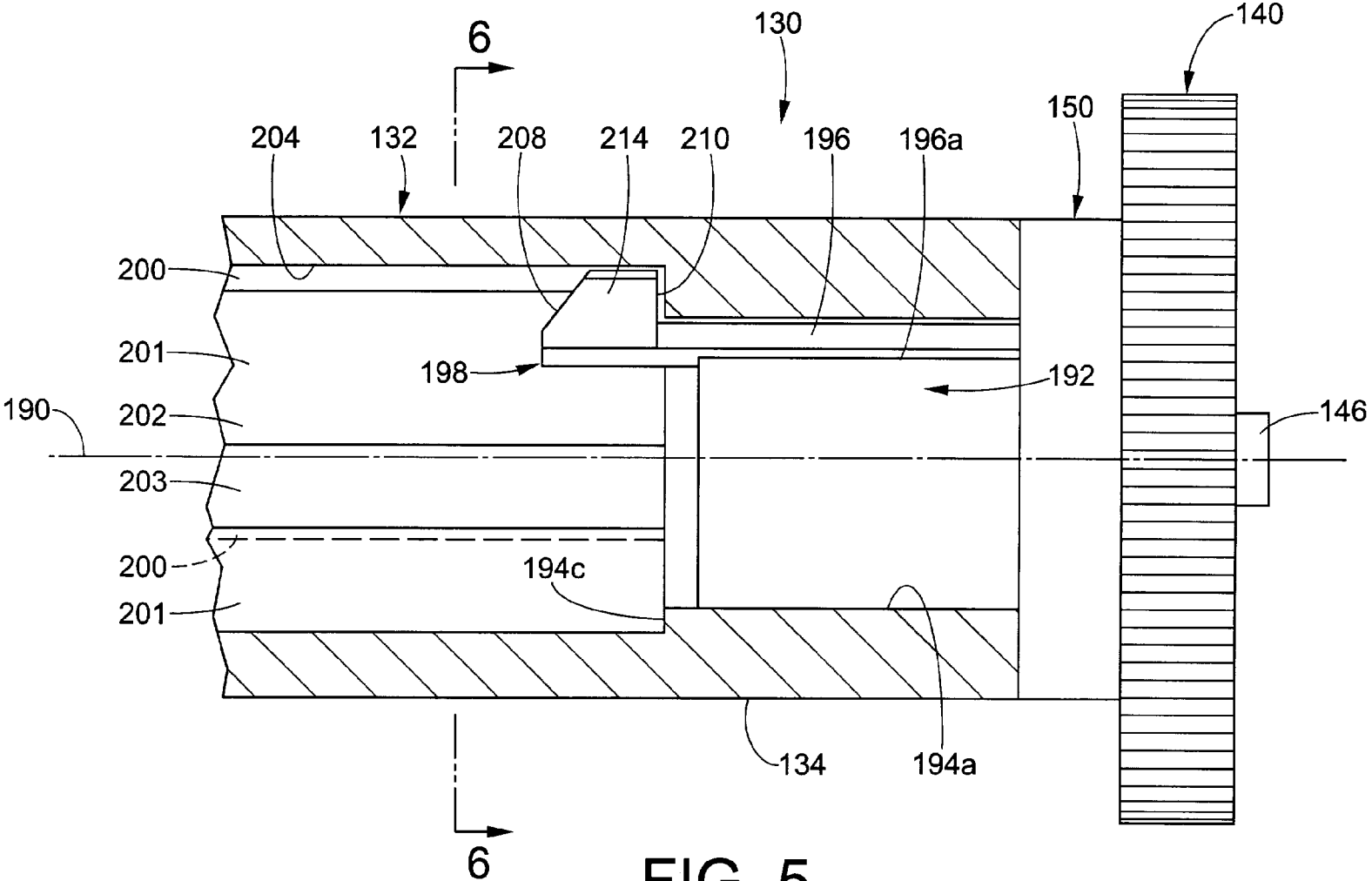
FIG. 5 is a side elevational view, partially in section, of the assembled parts of the spool illustrated in FIG. 4; and, FIG. 6 is a cross-sectional elevational view of the take-up spool looking in the direction of line 6—6 in FIG. 5.
Figure 6:
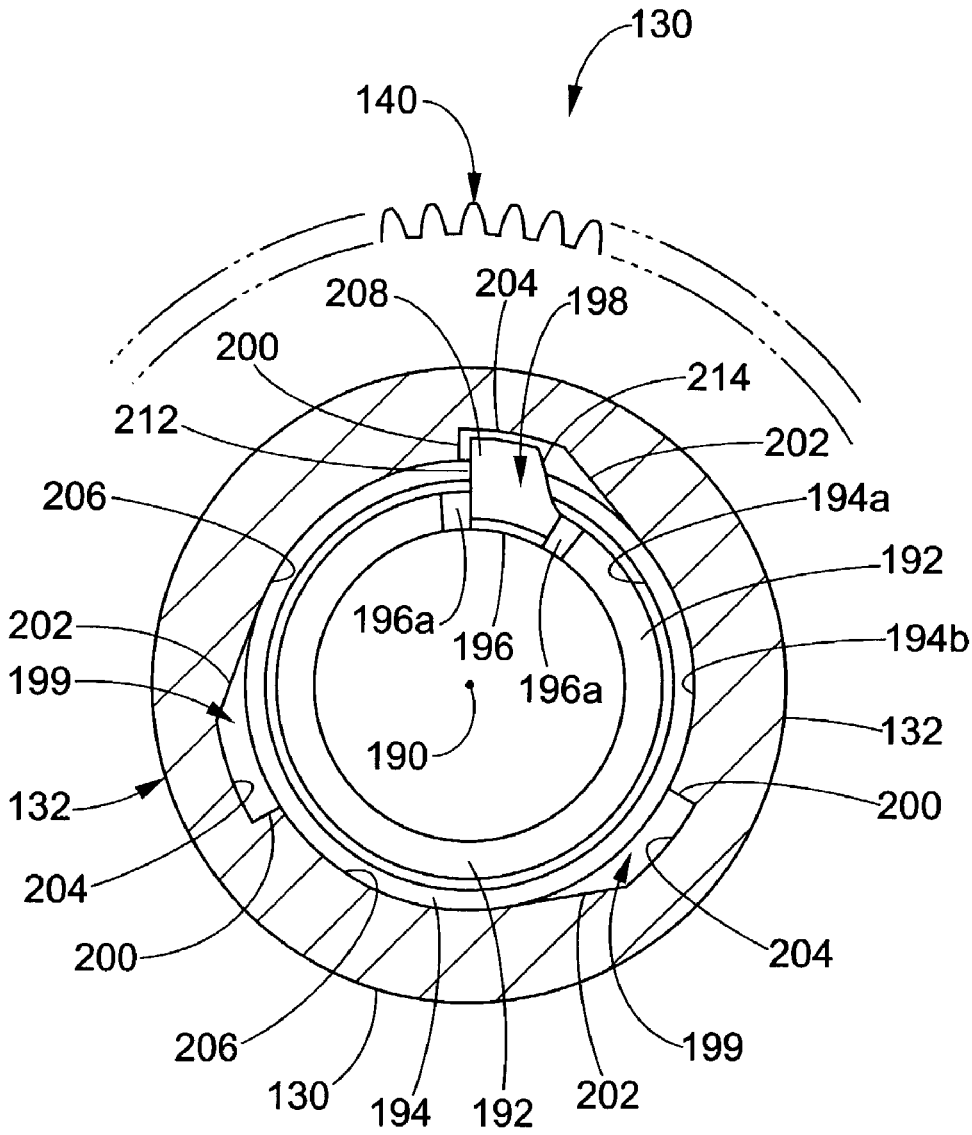

Referring to FIGS. 4, 5 and 6, take-up spool 130 has an axis 190 and as set forth above, comprises a spool tube 132 to which gear spindle 140 is attached. More particularly, gear spindle 140 has a hub 192 which is received in opening 194 in one end of spool tube 132. Opening 194 has an axially outer surface portion 194*a* which is circular in cross-section, an axially inner surface portion 194*b*, and a radially outwardly extending shoulder 194*c* therebetween and transverse to axis 190. Hub 192 is tubular, is rotatably supported by outer surface portion 194*a* and has a cantilever member 196 which is between and defined by slots 196*a* through the wall of the hub. At the axially inner end of the cantilever member is a drive lug 198 which extends beyond the inner end of hub 192 and shoulder 194*c* as seen in FIG. 5. Plastic spool tube 132 further has a plurality of recesses 199 in inner surface portion 194*b* which are equally spaced apart about axis 190 and extend axially from shoulder 194*c*. Each recess 199 includes a drive surface 200, a slip surface 202 circumferentially spaced therefrom, a bottom surface 204 between the drive and slip surfaces, and an arcuate surface 206 defined by a portion of inner surface 194*b* which extends from the radially inner end of drive surface 200 of one recess to the radially inner end of the circumferentially adjacent recess.

Figure 1A:
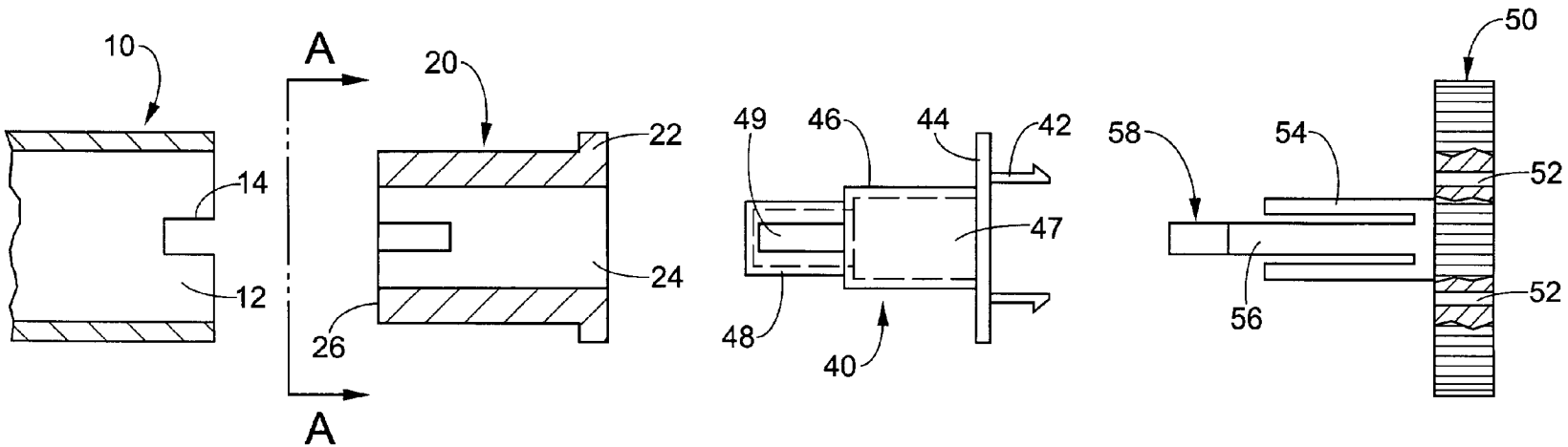
FIG. 1A (PRIOR ART)
FIG. 1A is an exploded elevational view in partial cross section illustrating a cardboard tube, a plastic tube insert, a hub, and a drive gear of a take-up spool according to a prior art design.
Figure 1B:
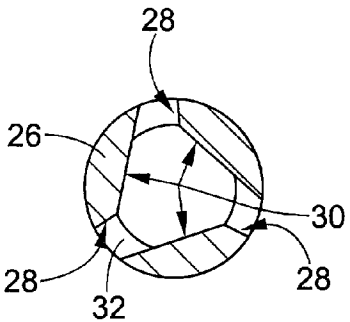
FIG. 1B (PRIOR ART)
FIG. 1B is an end view of the insert of FIG. 1A looking in the direction of line A—A.

Gear spindle 140 is mounted on tube 132 by inserting hub 192 into the tube until the cantilever member 196 extends past shoulder 194*c* into the portion of the tube which has recesses 199 therein. More particularly, drive lug 198 of the cantilever member has a tapered cam surface 208 on the axially inner end thereof and a locking shoulder 210 therebehind, as best seen in FIG. 5, and as best seen in FIG. 6, circumferentially spaced driving and sliding faces 212 and 214, respectively, extending axially between the cam surface and locking shoulder. During assembly, cam surface 208 engages the outer end of opening portion 194*a* and deflects cantilever member 196 radially inwardly of hub 192 until drive lug shoulder 210 passes shoulder 194*c* of opening 194. At that time, the cantilever member moves radially outwardly and upon rotation of spindle 140 relative to tube 132, drive lug 198 moves into alignment with one of the recesses 199, whereupon the cantilever arm moves radially outwardly to its initial position. In this position, shoulder 210 faces shoulder 194*c* and precludes axial separation of the spindle from tube 132. Referring to FIG. 6, if gear spindle 140 is rotated in a counter clockwise direction, drive surface 200 of notch 199 is engaged by driving surface 212 of drive lug 198 and provides a positive drive causing spool tube 132 to also rotate in a clockwise direction. If the gear spindle is rotated in a clockwise direction, again referring to FIG. 6, the sliding face 214 of drive lug 198 engages the slip surface 202 of the recess and slides along the surface and deflects the cantilever member inwardly, thus preventing rotation of spool tube 132 with the drive gear. Thus, the one-piece spool tube and spindle arrangement acts as a one-way clutch mechanism. It will be noted that when face 214 engages with slip surface 202 and, ultimately, with arcuate surface 203 between adjacent recesses 199, locking shoulder 210 remains radially outwardly of surface 194*a* so as to engage shoulder 194*c* and preclude removal of the spindle from the tube. The plastic spool tube can be used with either supply spools or take-up spools and, importantly, the plastic spool tube eliminates the need for the separate hub and insert components heretofore used with a cardboard spool tube. Advantageously, the plastic spool tube according to the present invention is also compatible with a two-piece gear hub as shown in FIG. 1.

The invention has been described with reference to a preferred embodiment. Obviously, alterations and modifications will occur to others upon a reading and understanding of this specification. The specification is intended to include all such modifications and alterations insofar as they come within the scope of the appended claims or the equivalents thereof.

Having thus described the invention, it is so claimed:

1. A take-up spool for an ink sheet cartridge, said spool including a tube having an axis and axially opposite ends, a circular inner surface at one of said ends, and a plurality of radially outwardly extending drive and clutch recesses spaced apart about said inner surface at a location spaced axially inwardly from said one end each said recess having a drive surface generally perpendicular to said inner surface and a slip surface circumferentially inclined relative to said inner surface.

2. A take-up spool according to claim 1, wherein said plurality of recesses is three recesses equally spaced apart about said inner surface.

3. A take-up spool for an ink sheet cartridge, said spool including a tube having an axis and axially opposite ends, an inner surface at one of said ends, and a plurality of radially outwardly extending drive and clutch recesses spaced apart about said inner surface at a location spaced axially inwardly from said one end, said inner surface including a first portion extending axially inwardly from said one end and having an inner end spaced from said one end, and a second portion extending axially inwardly from said inner end, said recesses being in said second portion.

4. A take-up spool according to claim 3, and a radially extending shoulder between said first and second portions of said inner surface.

5. A take-up spool according to claim 4, wherein said first portion of said inner surface is circular and said shoulder extends radially outwardly from said first portion.

6. A take-up spool according to claim 5, wherein said second portion of said inner surface is circular and said recesses extend radially outwardly from said inner surface of said second portion.

7. A take-up spool according to claim 6, wherein said recesses have an end coplanar with said shoulder.

8. A take-up spool according to claim 5, wherein each said recess has a drive surface generally perpendicular to said second portion of said inner surface and a slip surface at an angle to said second portion of said inner surface.

9. A take-up spool according to claim 8, wherein said second portion of said inner surface is circular and said slip surface is tangential thereto.

10. A take-up spool according to claim 8, wherein said second portion of said inner surface is circular and said recesses extend radially outwardly from said inner surface of said second portion.

11. A take-up spool according to claim 10, wherein said recesses have an end coplanar with said shoulder.

12. A take-up spool according to claim 11, wherein said slip surface is tangential to said second portion of said inner surface.

13. A take-up spool according to claim 12, wherein said plurality of notches is three notches equally spaced apart about said inner surface.

14. A take-up spool according to claim 11, wherein said plurality of notches is three notches equally spaced apart about said inner surface.

15. A take-up spool according to claim 11, wherein said tube is plastic.

16. A take-up spool for an ink sheet cartridge, said spool including a tube having an axis and axially opposite ends, a circular inner surface at one of said ends, a plurality of radially outwardly extending drive and clutch recesses spaced apart about said inner surface at a location spaced axially inwardly from said one end, and a spindle mounted on said one end and including a drive lug for engaging with said recesses each said recess has a drive surface generally perpendicular to said inner surface and a slip surface circumferentially inclined relative to said inner surface, said drive lug interengaging with said drive surface to preclude relative rotation between said tube and spindle and with said slip surface to allow relative rotation therebetween.

17. A take-up spool according to claim 16, wherein said drive lug and said inner surface interengage to retain said spindle on said one end.

18. A take-up spool according to claim 16, wherein said inner surface includes a first portion extending axially inwardly from said one end and having an inner end spaced from said one end, and a second portion extending axially inwardly from said inner end, said recesses being in said second portion.

19. A take-up spool according to claim 18, and a radially extending shoulder between said first and second portions of said inner surface, said drive lug interengaging with said shoulder to retain said spindle on said one end.

20. A take-up spool according to claim 18, wherein said spindle includes a cantilever member having an inner end axially inwardly of said inner end of said first portion of said inner surface, said drive lug being on said inner end of said cantilever member.

21. A take-up spool according to claim 20, wherein and said recesses extend radially outwardly from said inner surface of said second portion.

22. A take-up spool according to claim 21, and a radially extending shoulder between said first and second portions of said inner surface, said drive lug interengaging with said shoulder to retain said spindle on said one end.

23. A take-up spool according to claim 22, wherein said recesses have an end coplanar with said shoulder.

* * * * *